US005251767A

United States Patent [19]

Wiederer

[11] Patent Number: 5,251,767

[45] Date of Patent: Oct. 12, 1993

[54] END CAP FOR HANGER CADDY

[75] Inventor: Gregg E. Wiederer, Glenview, Ill.

[73] Assignee: Hanger Tight, Northbrook, Ill.

[21] Appl. No.: 800,548

[22] Filed: Nov. 27, 1991

[51] Int. Cl.[5] ..... A47H 13/00

[52] U.S. Cl. ..... 211/124; 211/7; 211/183

[58] Field of Search ..... 211/183, 124, 123, 7; 16/43, 2, 108; 403/292, 298, 359; 138/89; 248/56

[56] References Cited

U.S. PATENT DOCUMENTS 3,868,906 3/1975 Cameron .
4,037,728 7/1977 Cameron .
4,340,145 7/1982 Cameron ..... 211/124
4,735,534 4/1988 Oehlke ..... 248/564
4,753,355 6/1988 Simmerman et al. .
4,887,727 12/1989 Simmerman et al. .

*Primary Examiner*—Alvin C. Chin-Shue
*Attorney, Agent, or Firm*—Willian Brinks Olds Hofer Gilson & Lione

[57] ABSTRACT

An end cap for a garment hanger caddy includes an inner portion sized to fit into the end of a tubular member, an outer portion sized to abut the end of the tubular member, and a groove which extends at least partially around the end cap between the inner and outer portions. The inner portion comprises raised splines separated by substantially planar flats. The outer portion comprises raised ribs separated by arcuate interib surfaces.

10 Claims, 3 Drawing Sheets

Fig. 1
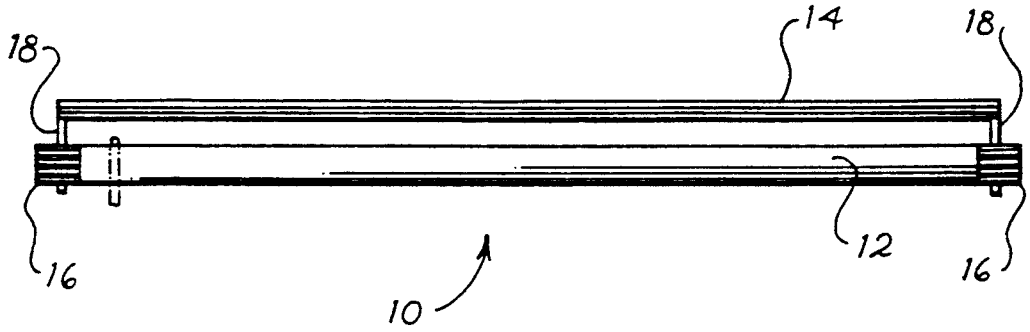
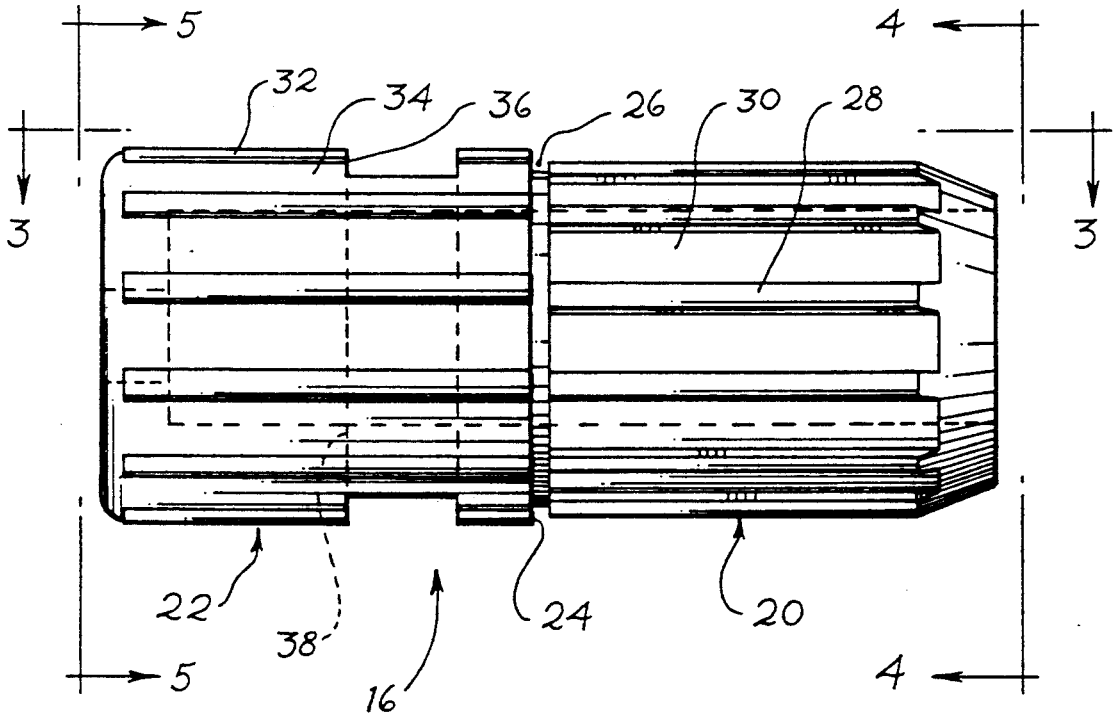
Fig. 2

Fig. 3
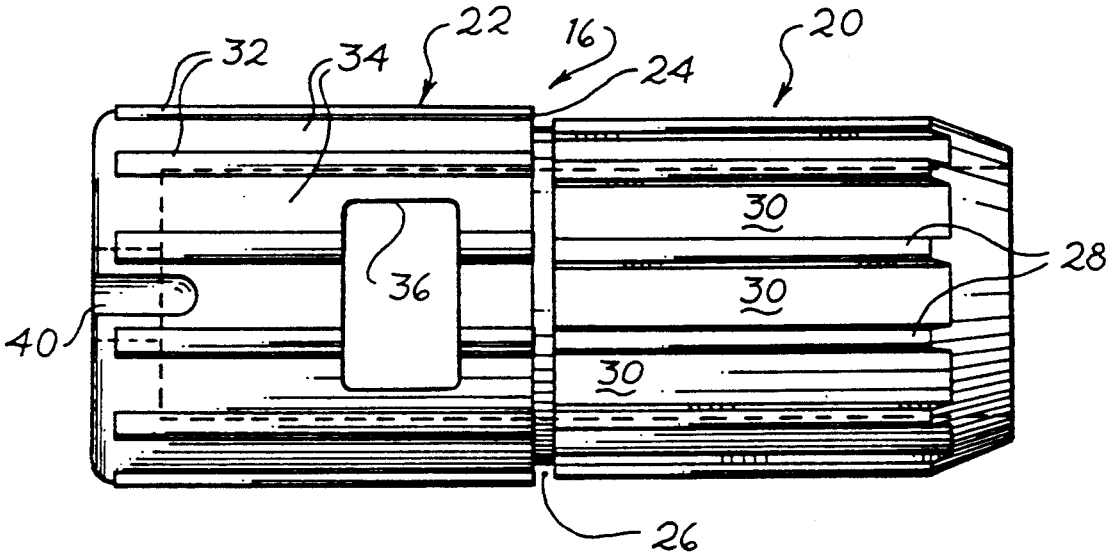
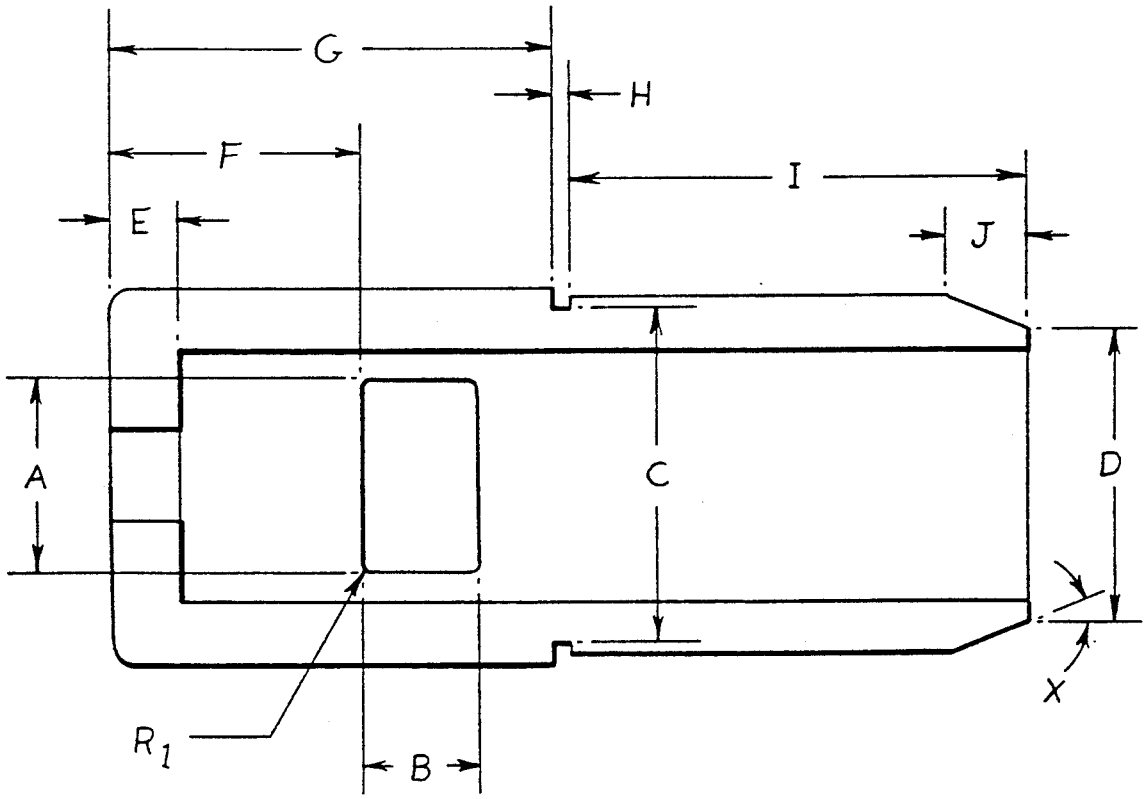
Fig. 6

END CAP FOR HANGER CADDY

BACKGROUND OF THE INVENTION

This invention relates to an improved end cap for a garment hanger caddy, and in particular to an end cap which provides an improved frictional engagement with the tube of the hanger caddy and which decreases the amount of sheared material that may collect around the end cap after assembly of the end cap into the tube.

Simmerman U.S. Pat. No. 4,887,727, Cameron U.S. Pat. No. 3,868,906 and Cameron U.S. Pat. No. 4,340,145 (all assigned to the assignee of the present invention) disclose three prior art garment hanger caddies. These hanger caddies are used to organize and retain garment hangers for storage and shipment. They have met with considerable commercial success, and have found acceptance in a variety of businesses.

Hanger caddies of the type described in the Simmerman and Cameron patents include a tube, a relatively stiff retainer strip that is substantially coextensive with the tube, and a pair of latching members. In the Simmerman patent, the latching members slide in openings formed in a pair of end caps which fit into respective ends of the tube. The end caps are held in the tube by a press fit.

Commercially suitable tubes may vary in internal diameter, primarily due to variations in the wall thickness of the tube. In the past, it has been important to maintain the internal diameter of the tube (and therefore the wall thickness) within a relatively narrow range in order to ensure that the end cap is properly held in place in the tube. In general, the cost of a tube will often decrease when tolerances for dimensional specifications are loosened. It would therefore be advantageous to have an improved end cap that holds properly within the tube even though the internal diameter of the tube is allowed to vary more widely.

During assembly the end caps are press fit into the tube, and there is a tendency for protruding edges of the end cap to be sheared off by the end of the tube. In the past, such sheared off material has often remained attached to the end cap for removal in a subsequent cleaning operation. It would be advantageous if such subsequent cleaning operations could be eliminated to reduce the cost of manufacture of the finished garment hanger caddy.

SUMMARY OF THE INVENTION

This invention relates to an improved end cap for a garment hanger caddy of the type that comprises a tubular member, a retainer strip substantially coextensive with the tubular member, a pair of end caps, each positioned in a respective end of the tubular member and a pair of latching members, each secured to a respective end of the retainer strip to secure the retainer strip in first and second positions with respect to the tubular member.

According to a first aspect of this invention, each end cap includes an inner portion sized to fit into the respective end of the tubular member, and this inner portion defines a plurality of splines in frictional contact with the tubular member and a plurality of substantially planar flats, each flat disposed between a respective adjacent pair of splines. Each end cap also defines an outer portion which defines a stop surface sized to abut the respective end of the tube.

As described below, the combination of splines and substantially planar flats allows the end cap to function properly with tubes having a relatively wide range of internal diameters.

According to a second aspect of this invention, each end cap includes an inner portion sized to fit into the respective end of the tube and an outer portion which defines a stop surface sized to abut the respective end of the tube. The end cap also defines a groove extending at least partially around the end cap between the inner and outer portions of the end cap adjacent the respective end of the tube.

This groove releases from the end cap material which is sheared off of the inner portion of the end cap when the end cap is press fit into the tube, thereby reducing or eliminating the need for a subsequent operation to cut the sheared material free of the end cap.

Further features and advantages of this invention are described in the following detailed description.

BRIEF DESCRIPTION OF THE DRAWINGS

FIG. 1 is a side view of a garment hanger caddy that incorporates a presently preferred embodiment of this invention.

FIG. 2 is a side view of one of the end caps included in the caddy of FIG. 1.

FIG. 3 is a side view taken along line 3—3 of FIG. 2.

FIG. 6 is a schematic view corresponding to FIG. 3, in which selected dimensions are defined.

DETAILED DESCRIPTION OF THE PRESENTLY PREFERRED EMBODIMENTS

Figure 4:
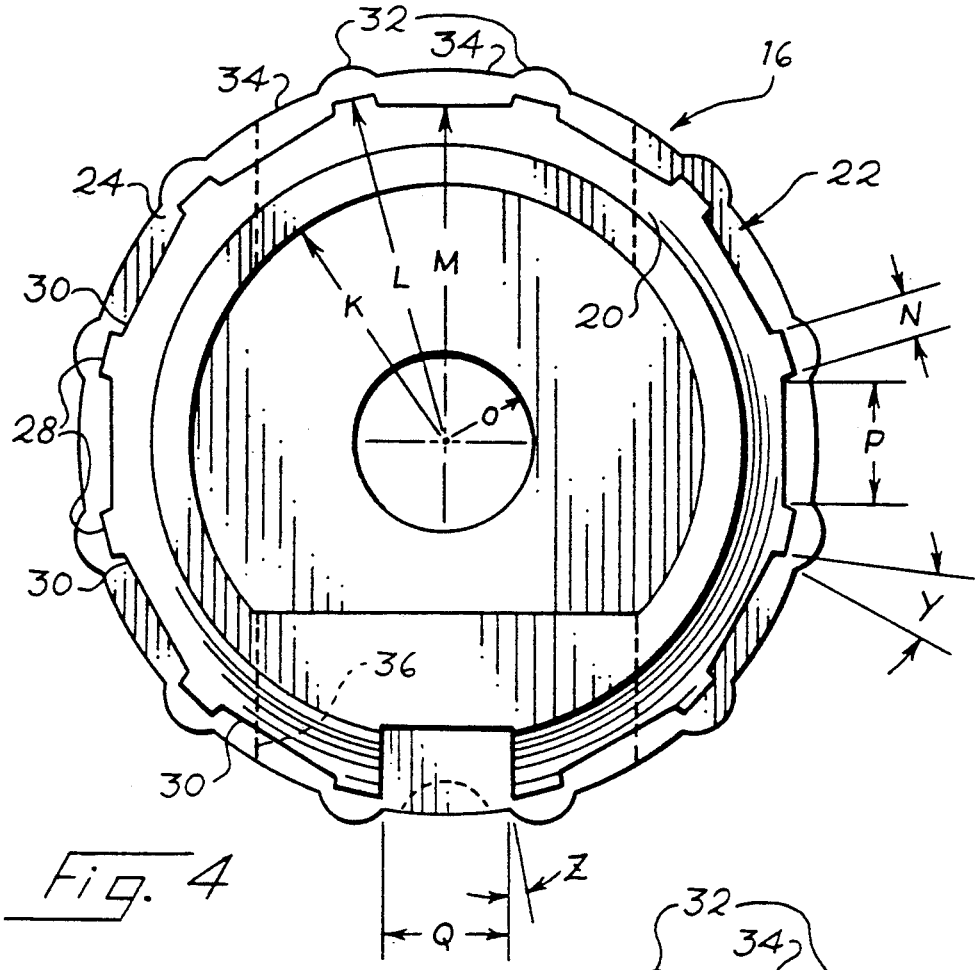
FIG. 4 is an end view taken along line 4—4 of FIG. 2.

Turning now to the drawings, FIG. 1 shows a hanger caddy 10 that incorporates a preferred embodiment of the present invention. The hanger caddy 10 includes a stiff metal tube 12 and a stiff retainer strip 14 which is arranged parallel to and substantially coextensive with the tube 12. A pair of end caps 16 are positioned in the ends of the tube 12. The retainer strip 14 is held in position on the tube 12 by a pair of latching members 18. The tube 12, retainer strip 14 and latching members 18 are conventional and may be formed as described in U.S. Pat. No. 4,887,727.

As shown in FIG. 2, each end cap 16 comprises an inner portion 20 which is sized to fit into a respective end of the metal tube 12, an outer portion 22 which defines a stop surface 24 sized to abut the respective end of the metal tube 12, and a groove 26 which extends at least partially around the end cap 16 between the inner portion 20 and the outer portion 22.

As shown in FIGS. 2 and 4, the inner portion 20 of the end cap defines raised splines 28 separated by substantially planar flats 30. The splines 28 are configured to frictionally engage the inside of the tube 12. Preferably there are twelve equally spaced splines 28 and twelve equally spaced flats 30.

Figure 5:
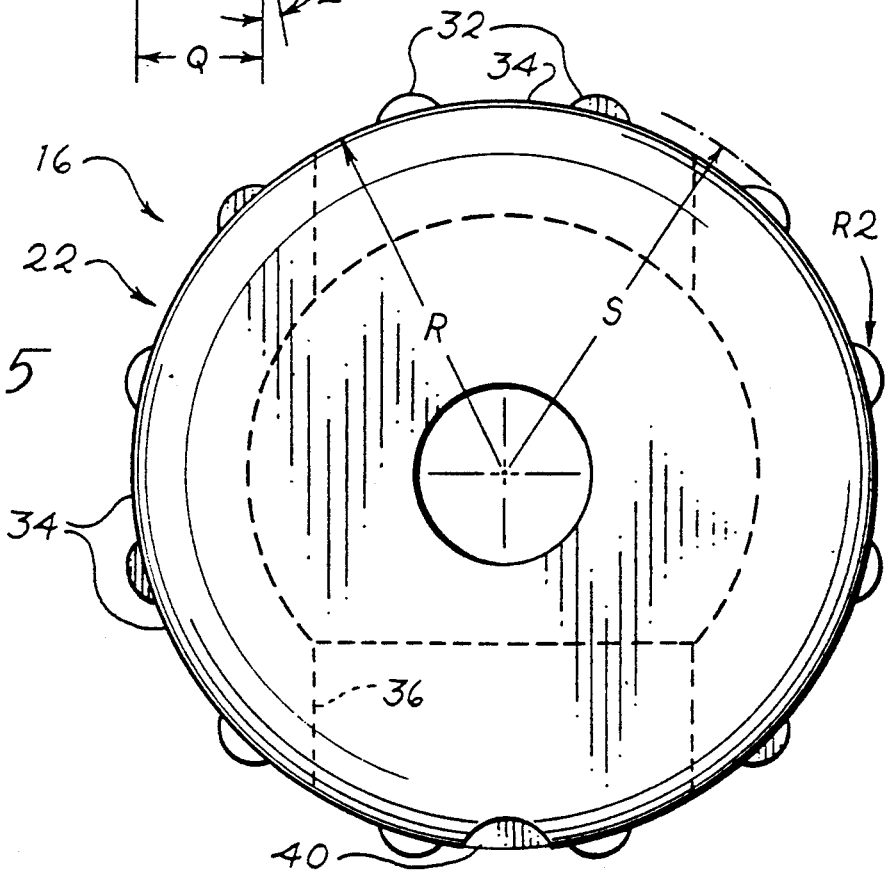
FIG. 5 is an end view taken along line 5—5 of FIG. 2.

As shown in FIGS. 2 and 5, the outer portion 22 of the end cap 16 comprises alternating elevated ribs 32 and arcuate interib surfaces 34. Preferably, there are twelve equally spaced ribs 32 and twelve equally spaced interib surfaces 34.

FIG. 3 shows a side view of the end cap 16 rotated to show a slot 36 which is sized to receive one of the latching members 18. The slot 36 is defined in part by a shoulder 38 (FIG. 2) that preferably defines a sharp corner to reduce any tendency of latching member 18 to accidentally release from the endcap.

FIG. 4 shows an end view of the end cap 16. Preferably, the radius L measured from the center of the end cap to a central surface of a spline 28 is greater than the radius M measured from the center of the end cap to the center of a flat 30.

Table 1 defines the presently preferred dimensions and angles of the end cap 16, using the reference symbols defined by FIGS. 2–6.

TABLE 1

| Reference Symbol | Dimension (inches or degrees) |
|---|---|
| A | .520 |
| B | .309 |
| C | .910 |
| D | .800 |
| E | .187 |
| F | .688 |
| G | 1.200 |
| H | .048 |
| I | 1.252 |
| J | .220 |
| K | .351 |
| L | .485 |
| M | .465 |
| N | .070 |
| O | .127 |
| P | .181 |
| Q | .170 |
| R | .510 |
| S | .533 |
| R1 | 0.010 |
| R2 | 0.050 |
| X | 21.2° |
| Y | 25° |
| Z | 5° |

In order to assemble the end caps 16 in the tube 12, the inner portion 20 is aligned with the end of the tube 12 and then the end cap 16 is pressed into position until the stop surface 24 defined by the outer portion 22 abuts the end of the tube 12. In this press fit operation the tube 12 will often shear off an upper layer of at least some of the splines 28. However, any material that is sheared off of the splines 28 is physically separated from the end cap 16 by the groove 26, which extends into the end cap 16 by a distance greater than the height of the splines 28. For this reason, any material sheared off of the end cap 16 tends to fall freely away from the end cap 16 once assembly is completed, and cutting operations to remove sheared material from the end cap 16 are substantially eliminated. This simplifies and reduces the cost of assembling the hanger caddy 10.

Additionally, it has been discovered that the preferred geometry defined above, and particularly the substantially planar configuration of the flats 30, allows the end cap 16 to function properly with tubes 12 having a relatively wide range of internal diameters. Because the flats 30 are flat rather than arcuate the splines 28 protrude above the flats 30 by a reduced amount. This is believed to assist in centering the end caps 16 properly, because even if an entire spline 28 is sheared off, the reduced height of the spline 28 reduces the resulting eccentricity. The use of the twelve rather than six splines 28 further assists proper centering of the inner portion 20 in the tube 12, as do the large dimension M and the frustoconical surface that defines angle X.

Surprisingly, the end cap 16 defined above has been found to function properly with lockseam tubes 12 having a predetermined outside diameter of 1.000 inches and a wall thickness which varies within the range of 0.015 to 0.025 inches. That is, the end cap 16 centers and frictionally engages properly in tubes throughout the range. Such relatively broad tolerances in the wall thickness are relatively easy to maintain at low cost. For this reason, the end cap 16 contributes to reducing the cost of the caddy 10 while maintaining a high level of performance.

Additionally, the end cap 16 defines an indexing key 40 to assist in aligning the rotational position of the end cap 16 in the tube 20 when the tube 20 is formed as a seamless rather than a lockseam tube. The ribs 32 are designed to cooperate with a mounting clip (not shown) to prevent the entire hanger caddy 10 from rotating once it is mounted in the clip. Furthermore, the sharp corner of the shoulder 38 (radius of about 0.002 inch) reduces any tendency of the latching member 18 to release accidentally, and the radius R1 allows free movement of the latching member 16.

The end cap 40 can be made of any suitable material. In the preferred embodiment a molded plastic such as the ABS resin sold by MONSANTO as LUSTRAN resin number 648–4000 has been found suitable. Of course, the invention is not limited to use with any particular material, or with the particular dimensions defined above. These dimensions have been provided only to clarify the configuration of the presently preferred embodiment.

From the foregoing description it should be apparent that an improved end cap has been described that provides a number of important advantages. This end cap enhances the fit of the end cap in the tube, reduces or eliminates the need for a clean up operation to remove sheared plastic, and can be used with metal tubes having a relatively wide variation in internal diameter. This end cap also reduces any tendency for the latching members to release accidentally.

Of course, it should be understood that a wide range of changes and modifications can be made to the preferred embodiments described above. It is therefore intended that the foregoing detailed description be regarded as illustrative rather than limiting, and that it be understood that it is the following claims, including all equivalents, which are intended to define the scope of the invention.

I claim:

1. In a garment hanger caddy of the type comprising a tubular member, a retainer strip substantially coextensive with the tubular member, and a pair of latching members, each secured to a respective end of the retainer strip, the improvement comprising:

a pair of end caps, each positioned in a respective end of the tubular member, each end cap comprising:

an inner portion sized to fit into a respective end of the tubular member, said inner portion defining a plurality of splines in frictional contact with the tubular member and a plurality of planar flats, each flat positioned between a respective adjacent pair of splines;

an outer portion which defines a stop surface sized to abut the respective end of the tubular member.

2. The invention of claim 1 wherein the outer portion of each end cap defines a plurality of ribs and a plurality of interib surfaces, each interib surface disposed between a respective adjacent pair of ribs.

3. The invention of claim 1 wherein the outer portion of each end cap defines a slot sized to receive a respective one of the latching members.

4. The invention of claim 1 wherein each end cap defines a groove extending at least partially around the end cap to intersect at least some of the splines, between the inner and outer portions of the end cap adjacent the respective end of the tubular member.

5. The invention of claim 1 wherein the plurality of splines comprise 12 equally spaced splines, wherein the plurality of substantially planar flats comprise 12 equally spaced flats, and wherein the splines alternate with the flats.

6. The invention of claim 2 wherein the plurality of ribs comprise twelve equally spaced ribs, wherein the plurality of substantially planar interib surfaces comprise twelve equally spaced interib surfaces, and wherein the ribs alternate with the interib surfaces.

7. The invention of claim 1 wherein the splines have a radius of 0.485 inches as measured from the center of the end cap to a central surface of the splines and the flats have a radius of 0.465 inches as measured from the center of the end cap to the center of the flat.

8. The invention of claim 2 wherein the ribs have a radius of 0.533 inches as measured from the center of the end cap to a central surface of the ribs and the interib surfaces have a radius of 0.510 inches as measured from the center of the end cap to the interib surfaces.

9. In a garment hanger caddy of the type comprising a tubular member, a retainer strip substantially coextensive with the tubular member, and a pair of latching members, each secured to a respective end of the retainer strip to secure the retainer strip in first and second positions with respect to the tubular member, the improvement comprising:

a pair of end caps, each positioned in a respective end of the tubular member, each end cap comprising:

an inner portion sized to fit into a respective end of the tubular member, said inner portion defining a plurality of splines frictionally engaged with the tubular member;

an outer portion which defines a stop surface sized to abut the respective end of the tubular member, said end cap defining a groove extending at least partially around the end cap to intersect at least some of the splines between the inner and outer portions of the end cap adjacent the respective end of the tubular member.

10. The invention of claim 9 wherein the outer portion of each end cap defines a slot sized to receive a respective one of the two latching members.

* * * * *